US008511251B2

(12) United States Patent
Sato

(10) Patent No.: US 8,511,251 B2
(45) Date of Patent: Aug. 20, 2013

(54) FILM DEPOSITION DEVICE AND METHOD THEREOF

(75) Inventor: Shintaro Sato, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 297 days.

(21) Appl. No.: 12/861,441

(22) Filed: Aug. 23, 2010

(65) Prior Publication Data

US 2011/0117275 A1 May 19, 2011

(30) Foreign Application Priority Data

Aug. 24, 2009 (JP) ..... 2009-193078

(51) Int. Cl.
*B05C 5/02* (2006.01)

(52) U.S. Cl.
USPC ..... 118/50; 118/308; 118/312; 239/290; 239/291

(58) Field of Classification Search
USPC ..... 118/50, 308, 312; 134/94.1, 103.1; 347/82, 84, 90; 239/290, 291
See application file for complete search history.

(56) References Cited

U.S. PATENT DOCUMENTS

| | | | | |
|---|---|---|---|---|
| 5,173,325 | A * | 12/1992 | Knobbe et al. | 427/476 |
| 5,356,292 | A * | 10/1994 | Ho | 433/88 |
| 5,795,626 | A * | 8/1998 | Gabel et al. | 427/458 |
| 6,280,802 | B1 | 8/2001 | Akedo et al. | |

FOREIGN PATENT DOCUMENTS

| | | | |
|---|---|---|---|
| JP | 59-80361 | A | 5/1984 |
| JP | 06-33241 | A | 2/1994 |
| JP | 2963993 | B | 10/1999 |
| JP | 2001-79505 | A | 3/2001 |
| JP | 2002-214065 | A | 7/2002 |

OTHER PUBLICATIONS

Stephen, Wall et al.,"Measurements of Kinetic Energy Loss for Particles Impacting Surfaces", Aerosol Science and Technology, vol. 12 Jan. 1, 1990, 926-946.

* cited by examiner

*Primary Examiner* — Laura Edwards
(74) *Attorney, Agent, or Firm* — Fujitsu Patent Center

(57) ABSTRACT

A film deposition device includes a nozzle configured to inject a plurality of particles to a target; and a suction unit provided around the nozzle and configured to suck particles that are rebounded from the target among the plurality of particles injected from the nozzle.

10 Claims, 16 Drawing Sheets

FILM DEPOSITION DEVICE AND METHOD THEREOF

CROSS-REFERENCE TO RELATED APPLICATION

This application is based upon and claims the benefit of priority of the prior Japanese Patent Application No. 2009-193078, filed on Aug. 24, 2009, the entire contents of which are incorporated herein by reference.

FIELD

Embodiments discussed herein generally relate to a film deposition device and method thereof.

BACKGROUND

Recently, particles have been applied to various industrial fields. The applications have increased year by year, for example, catalysts, cosmetic materials, and luminescent materials.

In recent years, a method to form a thin metal film and a ceramic film using particles has attracted attentions.

The method allows to form a relatively high quality film by processes in room temperature with high-speed, thus, applications, such as for a piezoelectric element and a capacitor have been developing.

In particular, a method to form a ceramic film using particles is called an "Aerosol deposition method" and many applications have been developing.

There are various thin film deposition methods utilizing particles, and there are various names for the methods. Hereinafter, the Aerosol Deposition method (AD method) that has been recently used as a method to deposit a ceramic film will be uniformly used regardless of the materials.

In the AD method, powders (particles) are made into aerosol by carrier gas and the aerosol that includes particles and the carrier gas is injected from a nozzle to a substrate under low pressure (about several Torr) to form a film.

Pressure of a film formation chamber (deposition chamber) is one digit or more lower than that of a powder chamber. Thus, aerosol injected from the nozzle reaches to sonic speed. Accordingly, the particles collide with the substrate at substantially maximum sonic speed. As a result, a dense film is formed over the substrate.

The following publications may be referred for related techniques: Japanese Laid-open Patent Publication No. S59-80361, Japanese Patent No. 2963993, Japanese Laid-open Patent Publication No. 2001-79505, Japanese Laid-open Patent Publication No. 2002-214065, Japanese Laid-open Patent Publication No. H6-33241, and Stephen Wall et al., "Measurements of Kinetic Energy Loss for Particles Impacting Surfaces", Aerosol Science and Technology, Vol. 12, pp. 926-946 (1990).

The AD method enables to form a dense film over a substrate by making particles collide with the substrate with high speed. However, particles reach to the substrate with high speed and thereby, many of the particles are rebounded from the substrate.

Accordingly, among the particles injected from the nozzle, those used for forming the film is very small and the use efficiency is typically 1% or less. Under the present circumstances, prepared powders are mostly wasted.

As illustrated in FIG. 16, the rebounded particles are gone off in the deposition chamber or over the substrate, thereby contaminate the chamber or the substrate. In other words, the rebounded particles may become a source of contamination. In particular, contamination of the substrate to be formed is not acceptable for electronic device applications.

SUMMARY

According to an aspect of the invention, a film deposition device includes a nozzle configured to inject a plurality of particles to a target; and a suction unit provided around the nozzle and configured to suck the particles that are rebounded from the target among the particles injected from the nozzle.

According to an another aspect of the invention, a film deposition method includes injecting a plurality of particles from a nozzle to a target to make the plurality of particles collide with the target to grow a film that includes the plurality of particles over the target; and sucking, by a suction unit provided around the nozzle, those particles rebounded from the target among the plurality of particles injected from the nozzle.

The object and advantages of the invention will be realized and attained by at least those features, elements, and combinations particularly pointed out in the claims.

It is to be understood that both the foregoing general description and the following detailed description are exemplary and explanatory and are not restrictive of the invention.

DESCRIPTION OF EMBODIMENTS

Figure 1:
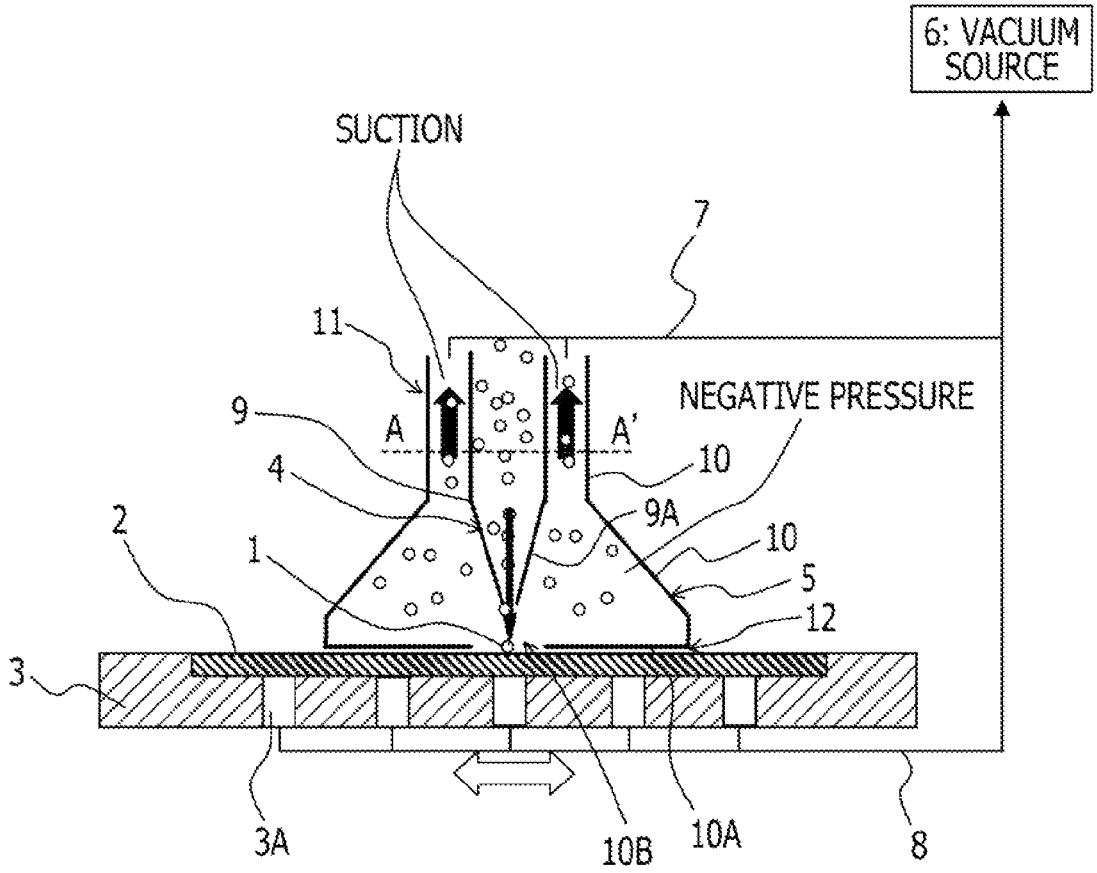
FIG. 1 is a schematic sectional view illustrating a film deposition device according to a first embodiment.

In the figures, dimensions and/or proportions may be exaggerated for clarity of illustration. It will also be understood that when an element is referred to as being "connected to" another element, it may be directly connected or indirectly connected, i.e., intervening elements may also be present. Further, it will be understood that when an element is referred to as being "between" two elements, it may be the only element layer between the two elements, or one or more intervening elements may also be present. Like reference numerals refer to like elements throughout.

According to a film deposition device and a film deposition method of the first embodiment, as illustrated in FIG. 1, a film that includes the particles 1 is grown over the substrate 2 by making particles 1 collide with a substrate 2 (target). The film that includes the particles 1 mainly includes the particles 1 and called a particulate film.

The film deposition device and the film deposition method also called a thin film deposition device and a thin film deposition method because the device and the method form a thin film over the substrate 2 using the particles 1. The device and method also called as a particulate deposition device and a particulate deposition method because the device and the method make the particles 1 collide with the substrate 2 to deposit the particles 1 over the substrate 2. For example, the film deposition method or device may be applicable for forming a catalyst metal film of a carbon nanotube.

The substrate 2 as a target may be a semiconductor substrate, a metal substrate, and an insulating substrate such as a glass. The target may not be limited to a substrate, for example, but may be an object over a surface of which a thin film of a semiconductor, metal, or insulating materials is formed, or may be a three dimensional object with a certain thickness.

The film deposition device, as illustrated in FIG. 1, includes a stage, base, or platform 3 configured to hold the substrate 2, a nozzle 4 configured to inject the particles 1 to the substrate 2, and a suction unit 5 provided around the nozzle 4 and configured to suck particles 1 that are not deposited over the substrate 2 among the particles injected from the nozzle 4.

In the film deposition method, the nozzle 4 injects the particles 1 to the substrate 2 to make the particles 1 collide with the substrate 2 and grow a film that includes the particles 1 over the substrate 2. The suction unit 5 provided around the nozzle 4 configured to suck the particles 1 that are not deposited over the substrate 2 among the particles 1 injected from the nozzle 4.

The particles 1 may be any of semiconductor particles, metal particles, or insulating particles. For example, alumina, PZT, barium titanate, zinc oxide, STO, IGZT, ITO, gold, silver, copper, and aluminum may be selected. The particles with a particle size of 5 μm or less may be used. Moreover, particles with a particle size of 3 μm or less, or 1 μm or less may be used. For example, nanoparticles (particles) with a particle size of 100 nm or less may be used.

The nozzle (injection nozzle) 4 makes the particles 1 collide with the substrate 2 to grow a film that includes the particles 1 over the substrate 2. The nozzle 4 injects the particles 1, sprays the particles 1 over the substrate 2 to make the particles 1 collide with the substrate 2, and thereby grows a film (a thin film) that includes the particles 1 over the substrate 2. Hence, the nozzle is also called a nozzle for depositing particles or a nozzle for forming a film.

Figure 2A:
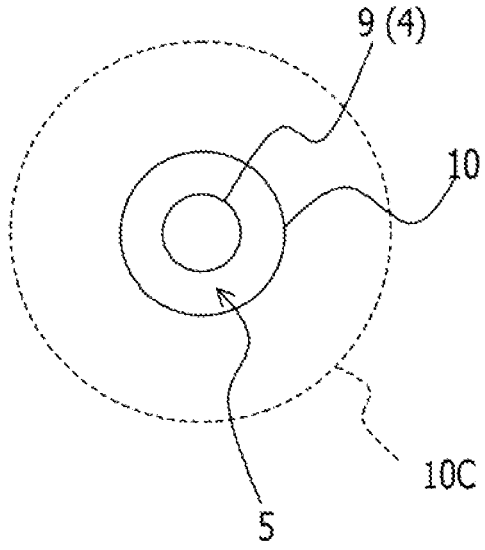
FIGS. 2A and 2B are schematic sectional views along the A-A' line in FIG. 1 illustrating configuration examples of a dual pipe nozzle provided with the film deposition device according to the first embodiment.
Figure 2B:
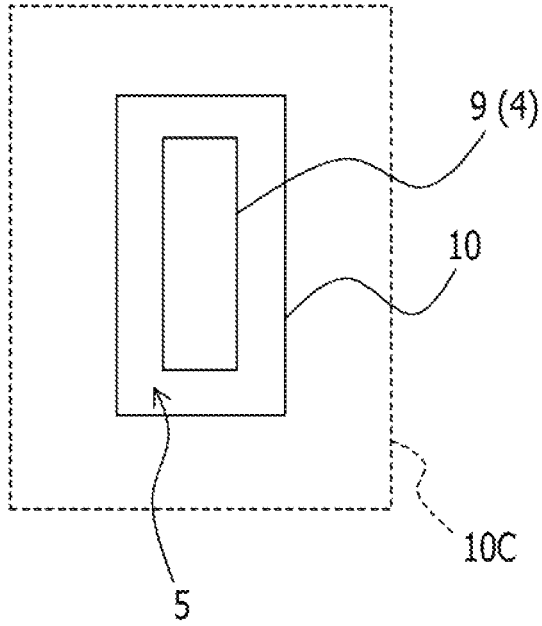

The nozzle 4 may be a circular nozzle with a cross-sectional shape illustrated in FIG. 2A, or may be a flat nozzle with a cross-sectional shape illustrated in FIG. 2B. Using the flat nozzle may grow a film that includes the particles 1 over a large area at once. When the flat nozzle is used, speed of the particles 1 may depend on a position of a longitudinal direction of the nozzle 4 and the speed of the particles 1 slows down at the edge, thereby a deposition state of the particles 1 may be changed.

As illustrated in FIG. 1, the suction unit 5 is coupled to a vacuum source 6 (a first vacuum source, a vacuum pump) through a piping 7. The vacuum source 6 exhausts gas (including particles) in the suction unit 5, thereby sucks and removes the particles 1 that are not deposited over the substrate 2. As a result, negative pressure prevails in the suction unit 5.

Figure 3:
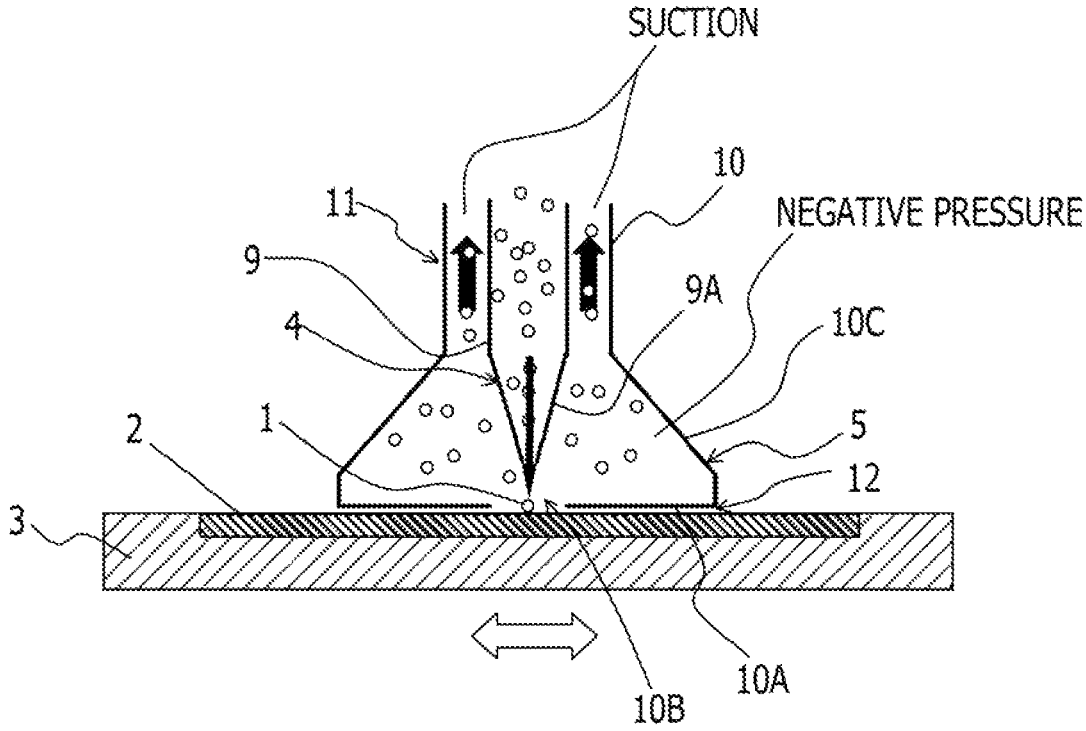
FIG. 3 is a schematic sectional view illustrating a configuration of an alternative embodiment of the film deposition device according to the first embodiment.

The stage 3 (substrate stage) includes retaining arrangement 3A configured to retain the substrate 2 in place. The substrate 2 is held to or retained by the retaining arrangement 3A of the stage 3. This is because sucking the particles 1 by the suction unit 5 may warp the substrate 2, or may peel off the substrate 2 from the stage 3. Alternatively, the stage 3 may not include a retaining arrangement particular retaining arrangement 3A but may be any object that may hold the substrate 2 as illustrated in FIG. 3 so that the substrate 2 may not be warped and peeled off from the stage 3.

As illustrated in FIG. 1, the retaining arrangement 3A of the stage 3 and the suction unit 5 may be coupled to the same vacuum source 6. For example, a piping 8 that is coupled to the retaining arrangement 3A of the stage 3 is physically coupled to the piping 7 that couples the suction unit 5 and the vacuum source 6. As described above, the substrate 2 may be retained (via vacuum suction) to the stage 3 with substantially the same pressure in the suction unit 5 by coupling the retaining arrangement 3A and the suction unit 5 to the same vacuum source 6. In this way, pressure in the suction unit 5 that is negative pressure and the pressure in the retaining arrangement 3A that retains the substrate 3 may be balanced. Pressures in the retaining arrangement 3A are substantially the same or lower than the pressure in the suction unit 5.

According to the embodiment, the nozzle 4 and the suction unit 5 are configured with a dual-pipe structure (multi structure) that includes a first pipe 9 and a second pipe 10 that is located outside of the first pipe 9.

The nozzle 4 is configured with the first pipe 9. In other words, the first pipe 9 located the inside (center) includes a tapered part 9A at the edge of the first pipe 9 a cross-section of the tapered part 9A becomes thinner with a tapered shape, and makes up the nozzle 4 (particle injection unit) that injects the particles 1 together with carrier gas to the substrate 2. The first pipe 9 is also called an internal nozzle 4 because the first pipe 9 is located the inside.

The second pipe 10 is mounted so as to cover the first pipe 9. A region between the first pipe 9 and the second pipe 10 becomes the suction unit 5. In other words, the region between the first pipe 9 and the second pipe 10 is coupled to the vacuum source 6, and becomes the suction unit 5 (particle suction unit) that sucks, together with the carrier gas, the particles 1 that are not deposited over the substrate 2. A cross-sectional shape of the suction unit 5 may be a shape corresponding to that of the nozzle 4, for example, the shapes as illustrated in FIGS. 2A and 2B.

The suction unit 5 configured with the first pipe 9 and the second pipe 10 is also called a suction nozzle that sucks carrier gas and the particles 1. Moreover, the suction unit 5 is also called an external nozzle because the suction unit 5 is located outside of the nozzle 4. The suction unit 5 is also called a ring-shaped suction pipe or a ring-shaped external pipe because the suction unit 5 is provided in a ring and pipe shapes at the outer periphery of the nozzle 4. An entire dual-pipe structure is also called a dual-pipe nozzle 11 (a multi-pipe nozzle, a nozzle with a suction pipe, a dual structure nozzle, a multi-structure nozzle).

In the second pipe 10, a tip end (injection unit) side of the nozzle 4 (the first pipe 9) is longer than the nozzle 4. The second pipe 10 includes a flat unit 10A (cover unit) that includes an opening portion 10B at a position opposing to the nozzle 4 so that an end part of the second pipe 9 at a side where the second pipe 10 is longer than the nozzle 4 is covered.

In the second pipe 10, the flat portion 10A opposes to the substrate 2, and the flat portion 10A and the substrate 2 are positioned so that a clearance 12 is provided therebetween. In other words, the flat portion 10A of the second pipe 10 is provided substantially in parallel with the substrate 2 and extends to a direction along a surface of the substrate 2.

The particles 1 injected from the nozzle 4 are sprayed against the substrate 2 through the opening portion 10B and deposited over the surface of the substrate 2. In this case, the particles 1 deposit over the region of the surface of the substrate 2 the size of which corresponds to a size of the opening of the injection unit of the nozzle 4. The region where the particles 1 deposit is called a deposition point. A region around the deposition point over the surface of the substrate 2 is substantially covered by the flat portion 10A. In other words, the second pipe 10 is provided so that the region around the deposition point over the surface of the substrate 2 is substantially covered by the flat portion 10A.

The particles 1 injected from the nozzle 4 may deposit over the deposition point over the surface of the substrate 2 and may not deposit or attach to a region around the deposition point. Among the particles 1 that collide with the substrate 2, the particles 1 that are rebounded from the substrate 2 are suctioned by the outer suction unit 5. Accordingly, scattering of the particles 1 may be reduced if not prevented, thereby the particles 1 may not contaminate periphery (for example, the deposition chamber) and the substrate 2.

The suction unit 5, in other words, a region between the first pipe 9 and the second pipe 10 is coupled to the vacuum source 6, thus the region is under a negative pressure (low pressure, reduced pressure). The suction unit 5 is provided so as to cover the nozzle 4, thus a region around the nozzle 4 is under a negative pressure.

Note that, as described above, the second pipe 10 that makes up the suction unit 5 includes the opening portion 10B, thus it is preferable that a size of the clearance 12 between the flat portion 10A and the substrate 2 is set to a size so that negative pressure is maintained in the suction unit 5.

When pressure in the suction unit 5 is negative pressure, gas flows into the suction unit 5 from the outside through the clearance 12 between the flat portion 10A and the substrate 2, and the opening portion 10B. For example, when a deposition chamber is provided and pressure in the deposition chamber is higher than pressure in the suction unit 5, carrier gas in the deposition chamber flows into the suction unit 5 through the clearance 12. When the deposition chamber is not provided, the outside is atmospheric pressure that is higher than pressure in the suction unit 5. Thus, outside air flows into the suction unit 5 through the clearance 12. As described above, leakage of the particles 1 to the outside (for example, a deposition chamber) may be reduced if not prevented by flowing gas through the clearance 12 between the flat portion 10A and the substrate 2.

A flow rate of gas that flows into the suction unit 5 and the deposition point may be adjusted by adjusting a size (width, height, and length) of the clearance between the flat portion 10A of the second pipe 10 and the substrate 2. Accordingly, pressure in the suction unit 5 and pressure in the deposition point may be adjusted.

For example, by adjusting a position of the second pipe 10 (dual pipe nozzle 11) or the substrate stage 3, a size (height) of the clearance 12 between the flat portion 10A of the second pipe 10 and the substrate 2 may be adjusted.

For example, by adjusting a size of the flat portion 10A of the second pipe 10, a size (width and length) of the clearance 12 between the flat portion 10A of the second pipe 10 and the substrate 2 may be adjusted.

Here, in order to make a length of the flat portion 10A of the second pipe 10 (a length along the substrate 2) long, the second pipe 10 includes a tapered part (skirt part) 10C a cross-section of which becomes larger with a tapered shape at an end of a side where the second pipe 10 is longer than the nozzle 4.

By adjusting a size of the clearance 12 between the flat portion 10A of the second pipe 10 and the substrate 2, pressure in the suction unit 5, in particular, pressure in a region from a tip end of the nozzle 4 to the substrate 2 (including the deposition point) may be maintained to negative pressure (low pressure) even when an outside of the dual pipe nozzle 11 is under atmospheric pressure. Accordingly, the particles 1 injected from the nozzle 4 are less likely to slow down, thereby the particles 1 may collide with the substrate 2 at high speed, and deposition of the particles 1 over the substrate 2 is promoted. Accordingly, a film that includes the particles 1 may be grown.

The deposition chamber may not be required to make negative pressure in the region around the nozzle 4, in particular, the region from the tip end of the nozzle 4 to the substrate 2 (including the deposition point). In other words, without providing the deposition chamber, the particles 1 may collide with the substrate 2 at high speed and the film that includes the particles 1 may be grown over the substrate 2.

By adjusting a size of the clearance 12 between the flat portion 10A of the second pipe 10 and the substrate 2, a flow rate of gas flowing into the suction unit 5 and the deposition point, and thus pressure in the suction unit 5 and the deposition point may be adjusted. Accordingly, the speed of the particles 1 may be controlled as well.

By moving (scanning) the nozzle 4 and the suction unit 5 (dual pipe nozzle 11), or the substrate stage 3 vertically and horizontally, a film that includes the particles 1 may be grown over the whole surface of the substrate.

Hereinafter, examples of specific configurations will be described by referring to FIGS. 4 and 5.

The film deposition device according to the examples of specific configurations is a device that forms a film by Aerosol deposition method.

Figure 4:
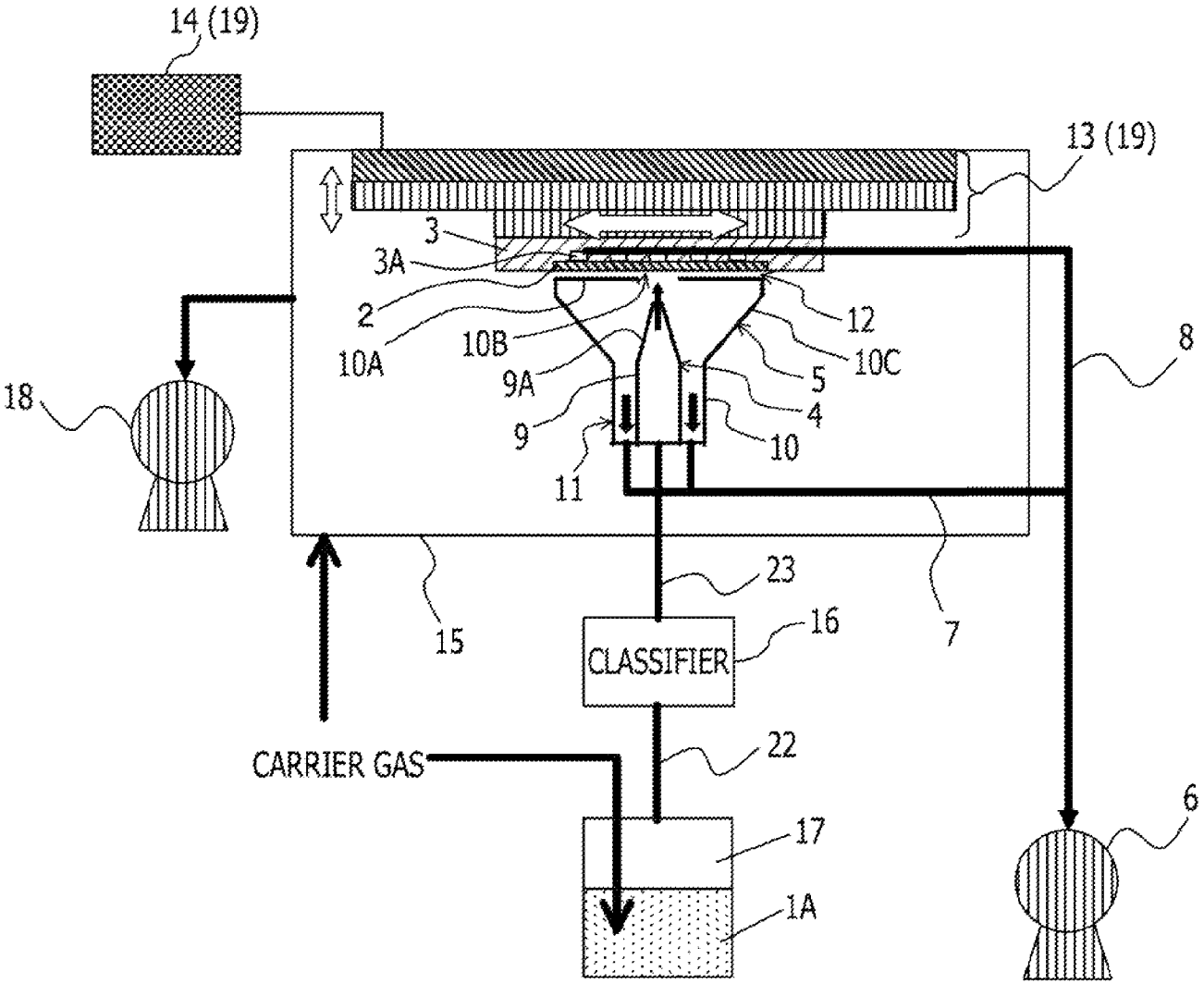
FIG. 4 is a schematic view illustrating a specific configuration example of the film deposition device according to the first embodiment.
Figure 5:
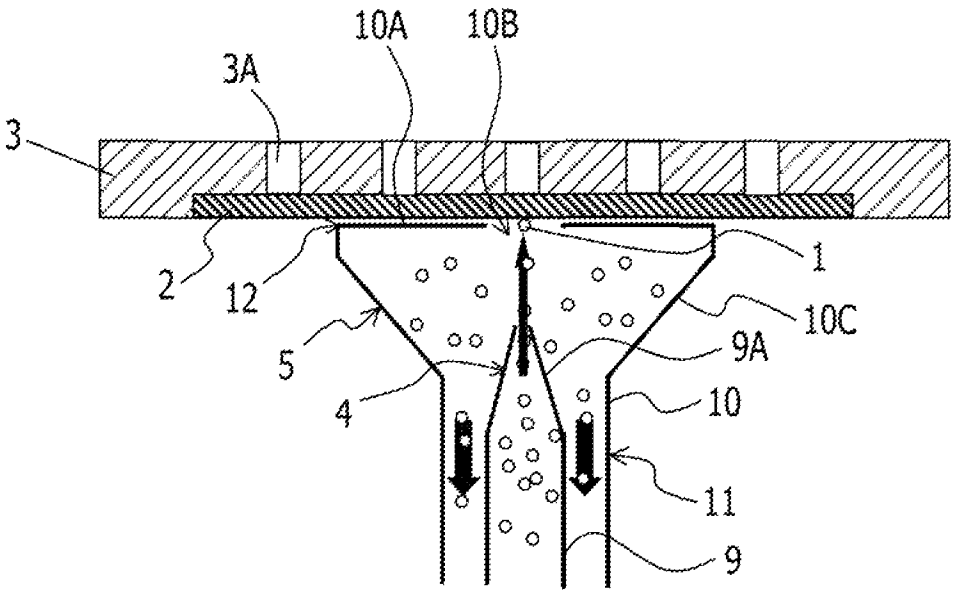
FIG. 5 is a schematic view illustrating a specific configuration example of the film deposition device according to the first embodiment.

As illustrated in FIG. 4, the film deposition device includes, in addition to elements of the film deposition device according to the first embodiment, a substrate stage driving unit 13, a controller 14, a deposition chamber (film formation chamber) 15, a classifier 16, a powder chamber 17, and a vacuum pump (a vacuum source) 18 that is coupled to the deposition chamber 15. In other words, the film deposition device includes a nozzle 4, a suction unit 5, a substrate stage 3 that includes a retaining arrangement 3A, the substrate stage driving unit 13, the controller 14, a vacuum pump (a vacuum source) 6, the deposition chamber 15, the classifier 16, the power chamber 17, and the vacuum pump (a vacuum source) 18. The same reference numerals are applied to elements that are the same as the elements in FIG. 1.

In the description using FIG. 1, the nozzle 4 and the suction unit 5 (dual pipe nozzle 11) are positioned at an upper part of, or above, the substrate 2. However, according to the configuration example, as illustrated in FIG. 5, the nozzle 4 and the suction unit 5 (dual pipe nozzle 11) are positioned at a lower part of, or below, the substrate 2. In this case, the particles 1 are upwardly injected from the nozzle 4 positioned at the lower part of the substrate 2. The particles rebounded from the substrate 2; in other words, among the particles 1 injected from the nozzle 4 those may not deposit over the substrate 2 fall down and guided in the suction unit 5 located the lower part of the substrate 2, thereby suctioned and removed. Thus, the particles 1 may be easily sucked and removed. In FIG. 5, the same reference numerals are applied to elements that are the same as the elements in FIG. 1.

The above described film deposition device grows a film that includes the particles 1 over the substrate 2 by making the particles 1 collide with the substrate 2 as described below.

As illustrated in FIG. 4, carrier gas is supplied to the powder chamber 17 to swirl powder (material of particles) in the powder chamber 17. Accordingly, aerosol that includes the particles 1 (for example, oxide particles such as alumina) that becomes film formation material and carrier gas is produced.

As carrier gas, for example, nitrogen, oxygen, argon, helium and mixture of these may be used. Here, for example, nitrogen gas is used and the flow rate is assumed to be about 10 liter per minute.

The particles 1 (aerosol) that are swirled by the carrier gas are transported, together with the carrier gas, to the classifier 16 through the piping 22. Here, an impactor is used as the classifier 16, and for example, the particles with a size of about 500 nm or more are removed.

The classified particles 1 (here, particles with a size of about 500 nm or less, aerosol) are guided to the nozzle 4 (inside of the first pipe 9) through the piping 23. The particles 1 are injected from the tip end of the nozzle 4 to the substrate 2 together with carrier gas and sprayed over the substrate 2 through the opening portion 10B of the second pipe 10 (external pipe) that is mounted so as to substantially cover the nozzle 4. As will be described later, pressure in a region between the tip end of the nozzle 4 and the substrate 2 is negative pressure, and lower than pressure in the powder chamber 17. Thus, the pressure difference allows the particles 1 to collide with the substrate 2 at high speed and to grow a film that includes the particles 1 over the substrate 2.

For example, the nozzle 4 may be a flat structure, and an inside dimension around an exit is about 30 mm horizontally, and about 0.5 mm vertically. For example, a distance between a tip end of the nozzle 4 and the substrate 2 is about 20 mm.

The flat portion 10A of the second pipe 10 is substantially in parallel with the substrate 2. The clearance 12 between the flat portion 10A of the second pipe 10 and the substrate 2 is, for example, about 0.2 mm.

For example, a size of the opening portion 10B (hole) of the flat portion 10A is about 35 mm horizontally, and about 10 mm vertically.

In this case, pressure in the suction unit 5, in particular the region between the tip end of the nozzle 4 and the second pipe 10, and the deposition point is about 130 Pa, and about 201 pm gas flows from the clearance 12 between the flat portion 10A of the second pipe 10 and the substrate 2. Pressure in the suction unit 5 and the deposition point depends on exhaust velocity of the vacuum pump 6 that is coupled to the suction unit 5.

Pressure in the suction unit 5 and the deposition point is desired for controlling behavior of the particles 1.

Hence, the nozzle 4, the suction unit 5, and the substrate 2 etc. are housed in the deposition chamber 15 and the deposition chamber 15 is coupled to the vacuum pump 18 so as to control pressure in the deposition chamber. In this way, by controlling pressure in the deposition chamber 15, a flow rate of gas that flows from the clearance 12, thereby pressure in the suction unit 5 and the deposition point may be accurately controlled.

Pressure in the deposition chamber 15 may be negative pressure (low pressure), or atmospheric pressure. However, it is preferable that the pressure is higher than the pressure in the suction unit 5 in order to reduce if not preventing the particles 1 from leaking to the deposition chamber 15.

For example, a size (height) of the clearance 12 may be adjusted by providing the driving unit (substrate stage driving unit) 13 to the substrate stage 3 and controlling the driving unit 13 by the controller 14, thereby controlling a position of the substrate stage 3. The position of the substrate 3 is controlled vertically up and down along a paper surface. The substrate stage driving unit 13 and the controller 14 are configured to control the position of the substrate stage 3 thereby collectively called a stage position adjustment unit 19.

Figure 6:
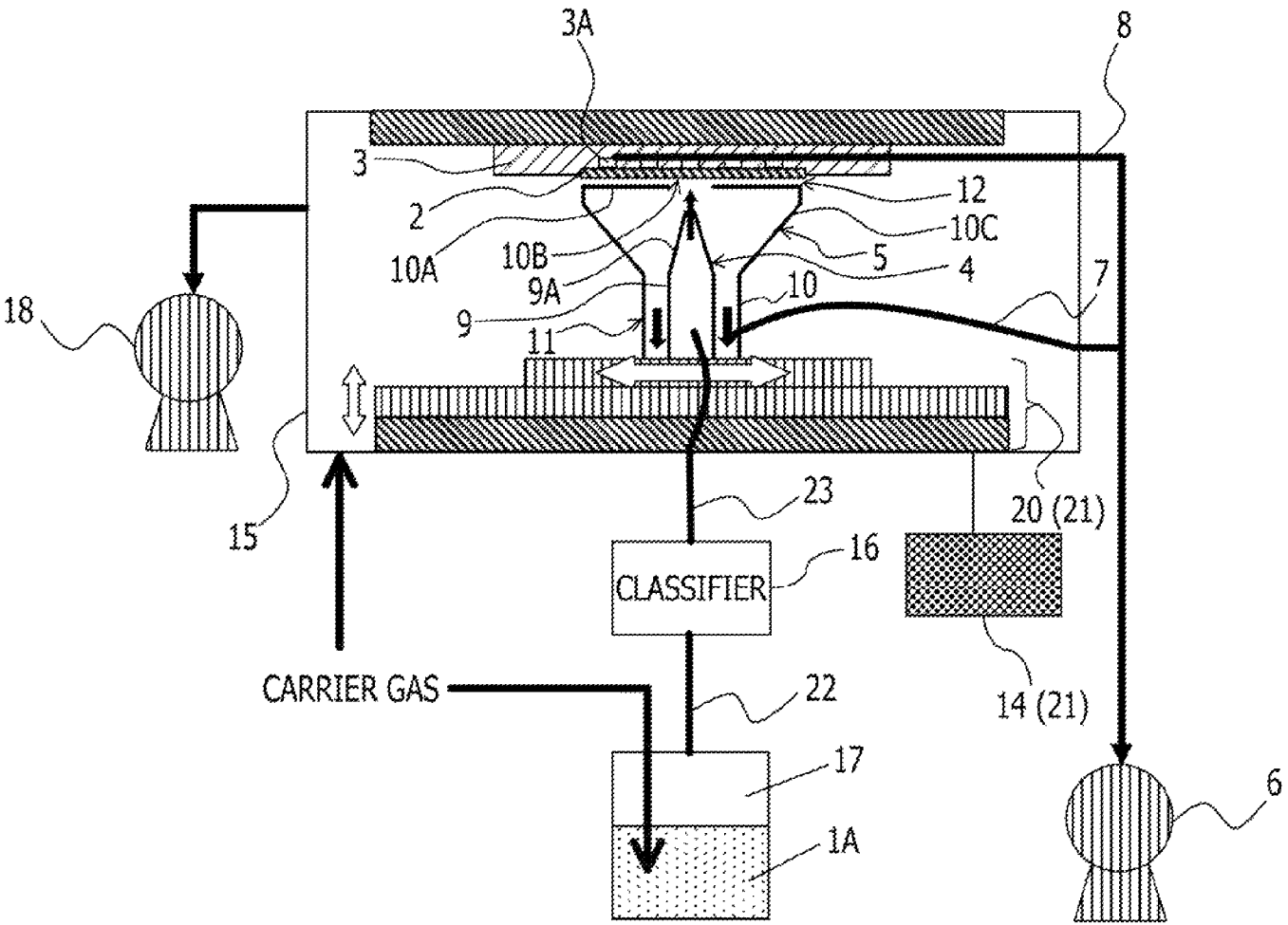
FIG. 6 is a schematic view illustrating a specific configuration example of an alternative embodiment of the film deposition device according to the first embodiment.

Here, the substrate stage driving unit 13 is provided to the substrate stage 3, however the substrate stage driving unit 13 may be provided to another element. For example, as illustrated in FIG. 6, a size (height) of the clearance 12 may be adjusted by providing a driving unit (nozzle driving unit) 20 to the second pipe 10 (dual pipe nozzle 11) and controlling the driving unit 20 by the controller 14, thereby controlling a position of the second pipe 10 (dual pipe nozzle 11). The nozzle driving unit 20 and the controller 14 are configured to control the position of the second pipe 10 (dual pipe nozzle 11) thereby collectively called a nozzle position adjustment unit 21. In FIG. 6, the same reference numerals are applied to elements that are the same as the elements in FIG. 4.

Gas that is supplied to the deposition chamber 15 may be similar type or different type of the carrier gas supplied to the powder room 17, in other words, gas that is injected from the nozzle 4 together with the particles 1. However, supplying the similar type of gas to the deposition chamber 15 allows strict control of type of gas of the deposition point; thereby a good quality film may be obtained.

The carrier gas injected from the nozzle 4, gas that is guided to the suction unit 5 from the deposition chamber 15 through the clearance 12, and the particles 1 rebounded from the substrate 2, in other words, the particles 1 that are not deposited over the substrate 2 are guided to the vacuum pump 6 by passing through the suction unit 5 and exhausted to the outside.

As a result, scattering of the particles 1 in the deposition chamber 15 may be reduced if not prevented, thereby contamination of the deposition chamber 15 and the substrate 2 may be reduced if not prevented.

By two-dimensionally moving (scanning) the nozzle 4 and the suction unit 5 (dual pipe nozzle 11), or the substrate stage 3, a film may be substantially uniformly formed over a desired region of the substrate 2 by using the particles 1.

For example, a longitudinal length of an opening of the injection unit of the nozzle 4 is assumed to be about 30 mm. The substrate stage 3 is moved about 100 mm toward a direction that is orthogonal to the longitudinal direction of the nozzle 4 (one direction). The substrate stage 3 is moved about 1 mm toward the longitudinal direction of the nozzle 4. The substrate stage 3 is moved about 100 mm toward a direction that is orthogonal to the longitudinal direction (reverse direction) of the nozzle 4. The substrate stage 3 is moved about 1 mm toward the direction that is orthogonal to the longitudinal direction (reverse direction) of the nozzle 4. When the substrate stage 3 is moved about 100 mm toward the longitudinal direction by repeating the above movements, a film that includes the particles 1 with a certain thickness may be formed over a region about 100 mm×70 mm.

For example, as illustrated in FIG. 4, a position of the substrate stage 3 for the nozzle 4 and the suction unit 5 (dual pipe nozzle 11) may be adjusted by providing the driving unit (substrate stage driving unit) 13 to the substrate stage 3 and controlling the driving unit 13 by the controller 14. The position of the substrate stage 3 is controlled by moving the substrate stage 3 toward right and left along the paper surface and toward a direction that is perpendicular to the paper surface. The substrate stage 3 is called a movable substrate stage with a vacuum chuck. The substrate stage driving mechanism 13 and the controller 14 are for adjusting a position of the substrate stage 3 for the dual pipe nozzle 11, thereby collectively called the stage position adjustment unit 19.

For example, as illustrated in FIG. 6, a position of dual pipe nozzle 11 for the substrate stage 3 may be adjusted by providing the driving unit (nozzle driving unit) 20 to the nozzle 4 and the suction unit 5 (dual pipe nozzle 11) and controlling the driving unit 20 by the controller 14. The position of the dual pipe nozzle 11 is controlled by moving the dual pipe nozzle 11 toward right and left along the paper surface and toward a direction that is perpendicular to the paper surface. In this case, a flexible tube may be used for the piping 7 that couples the suction unit 5 and the vacuum pump 6, and a piping 23 that couples the classifier 16 and the nozzle 4. The nozzle driving unit 20 and the controller 14 are configured to adjust a position of the dual pipe nozzle 11 for the substrate stage 3, thereby collectively called a nozzle position adjustment unit 21.

According to the film deposition device and the film deposition method of the embodiment, a film that includes the particles 1 may be formed over the substrate 2 by making the particles 1 collide with the substrate 2 while reducing if not preventing scattering of the particles 1 and reducing if not preventing contamination of the deposition chamber 15 and the substrate 2 by the particles 1.

Figure 7:
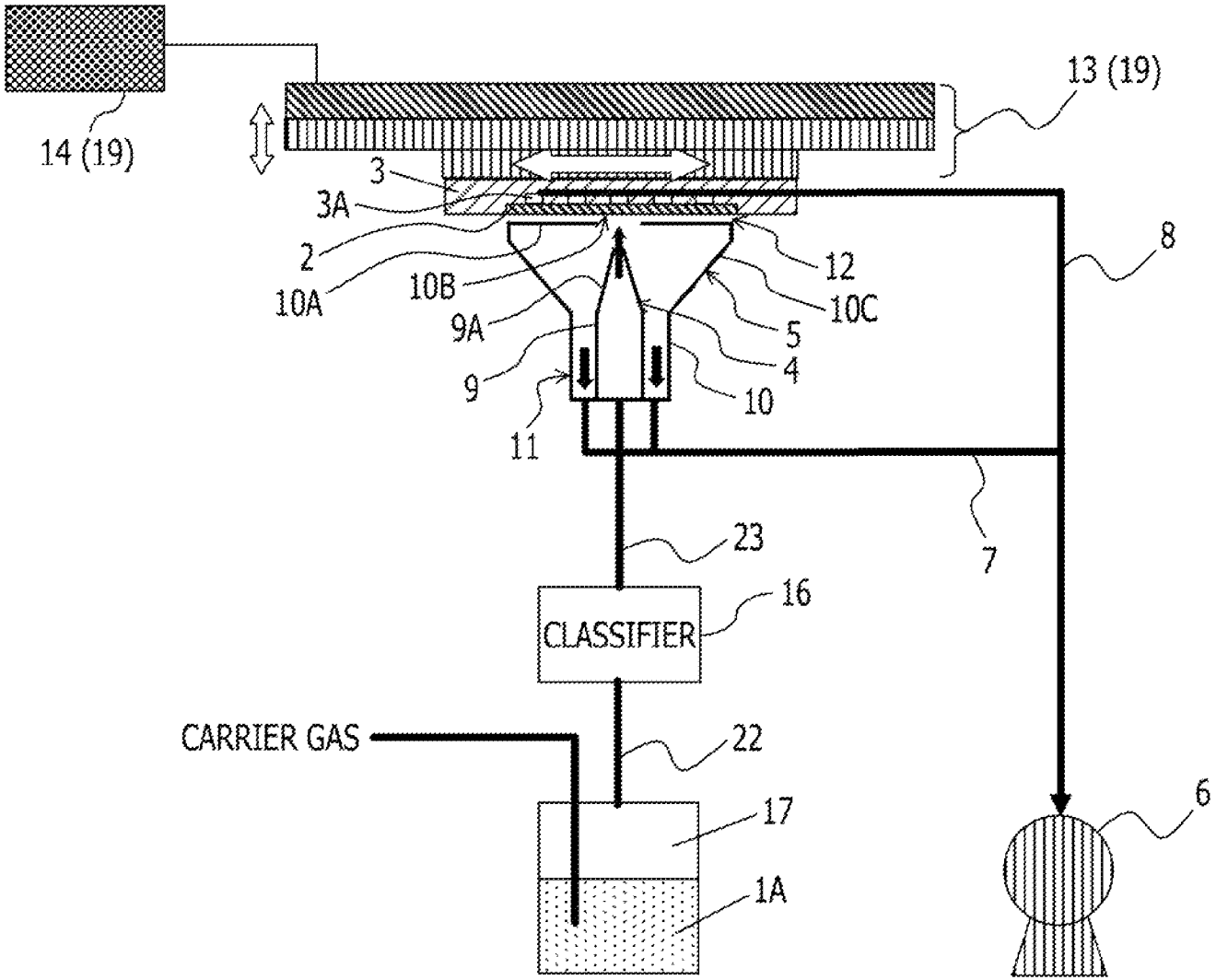
FIG. 7 is a schematic view illustrating a specific configuration example of an alternative embodiment of the film deposition device according to the first embodiment.

According to the above described embodiment, the deposition chamber 15 is provided. However, as illustrated in FIG. 7, the deposition chamber 15 may not be provided. For example, when adjusting the clearance 12 between the flat portion 10A of the second pipe 10 and the substrate 2 is sufficient to accurately control pressure in the suction unit 5 and the deposition point, the deposition chamber 15 may not be provided as illustrated in FIG. 7. In this case, the substrate stage 3 is provided so that the substrate 2 is located at the lower side of the substrate stage 3 in atmospheric air, and the nozzle 4 and the suction unit 5 (dual pipe nozzle 11) are located at the lower side of the substrate stage 3 with a tip end of the nozzle 4 and the opening portion 10B of the suction unit 5 positioned above. Accordingly, a film using the particles 1 may be formed easily. The particles 1 that are rebounded from the substrate 2, thereby not deposited over the substrate 2 are sucked (collected) by the suction unit 5. Therefore, the surroundings are not contaminated. In FIG. 7, the same reference numerals are applied to elements that are the same as the elements in FIG. 4.

Figure 8:
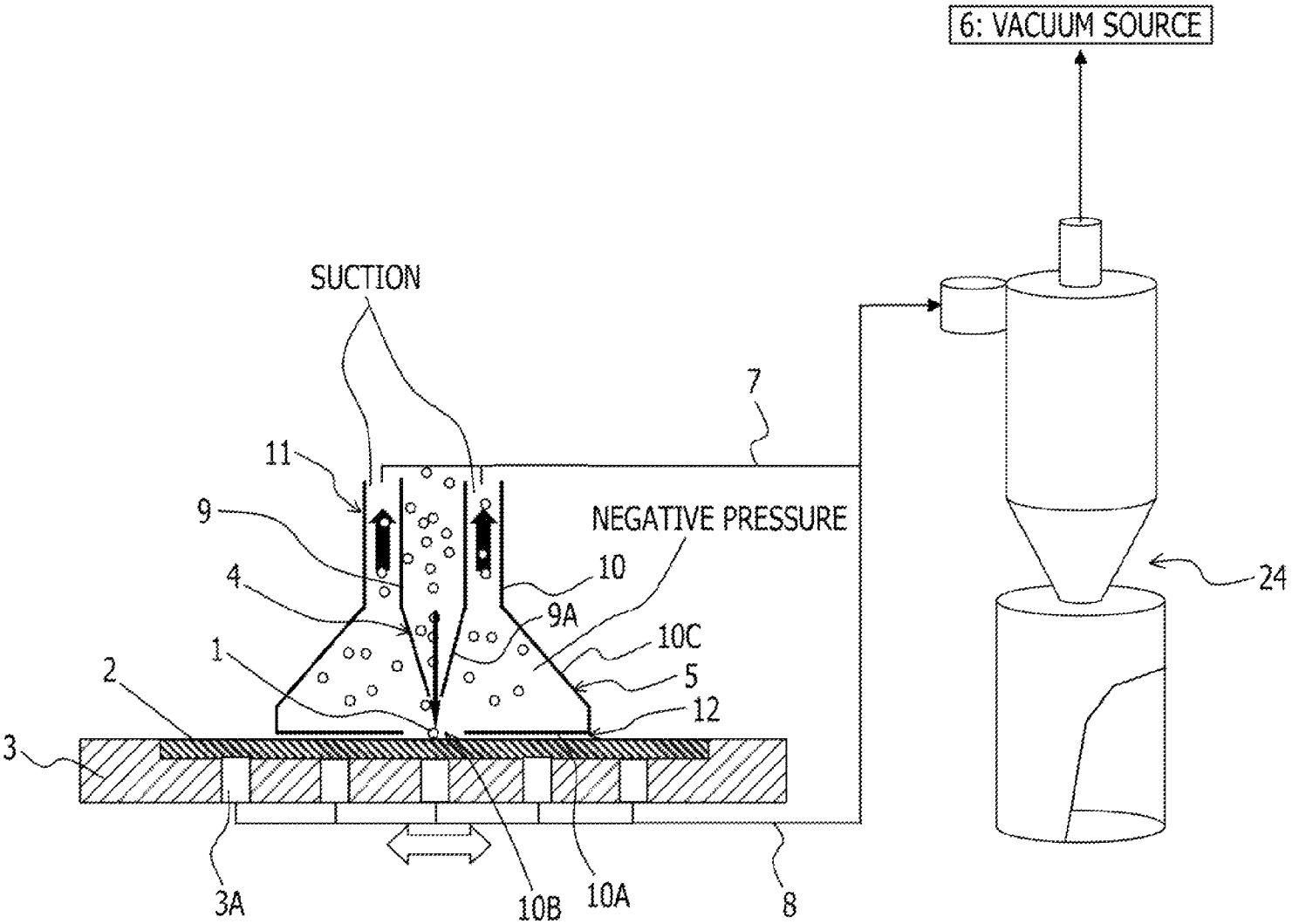
FIG. 8 is a schematic view illustrating a specific configuration example of an alternative embodiment of the film deposition device according to the first embodiment.

According to the above described embodiment, the suction unit 5 is directly coupled to the vacuum source 6; however, the coupling is not limited to this. For example, as illustrated in FIG. 8, the suction unit 5 may be coupled to the vacuum source 6 through a collection unit 24 such as a cyclone (dust collector) and the particles 1 may be collected in the collection unit 24 that is coupled to the suction unit 5. In other words, the film deposition device may be configured with the collection unit 24 that is coupled to the suction unit 5 and that collects the particles 1. Accordingly, the particles 1 that are not deposited over the substrate 2 may be collected and reused. In FIG. 8, the same reference numerals are applied to elements that are the same as the elements in FIG. 1.

The difference between the above described first embodiment (refer to FIG. 1) and a second embodiment is that in the first embodiment, the nozzle 4 and the suction unit 5 make up the dual-pipe structure, whereas in a film deposition device of the second embodiment, a nozzle 4 and a suction unit 5 make up a triple-pipe structure.

Figure 9:
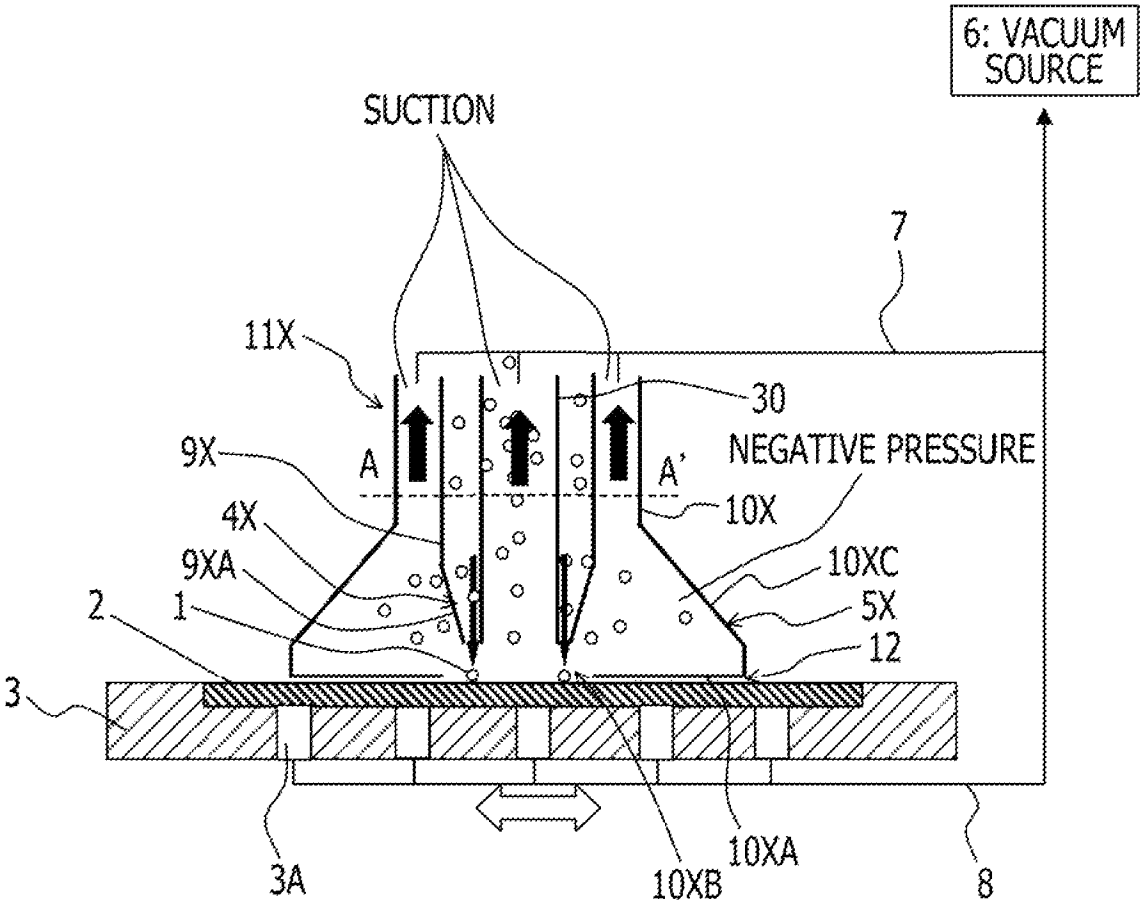
FIG. 9 is a schematic sectional view illustrating a configuration of a film deposition device according to a second embodiment.

According to the second embodiment, as illustrated in FIG. 9, a nozzle 4X and a suction unit 5X make up a triple pipe structure (multiple structure) that includes a first pipe 9X, a second pipe 10X that is located outside of the first pipe 9X, and a third pipe 30 that is located inside of the first pipe 9X. In FIG. 9, the same reference numerals are applied to elements that are the same as the elements in FIG. 1.

A nozzle 4X for injecting particles 1 toward a substrate 2 is configured in a region between the first pipe 9X and the third pipe 30 in order to grow a film that includes the particles 1 over the substrate 2 by making the particles 1 collide with the substrate 2.

Here, a region between the first pipe 9X and the third pipe 30 is a ring shape, thus the nozzle is a ring-shaped nozzle 4X. Accordingly, compared with the nozzle 4 with the shape of the above described first embodiment, the ring-shaped nozzle may grow a film that includes the particles 1 over a large area at a time.

A tip end of the first pipe 9X includes a tapered part 9XA the cross-section of which becomes thinner with a tapered shape. A tip end of the nozzle 4X, in other words, a region between the first pipe 9X and the third pipe 30 includes a tapered part the cross-section of which becomes thinner with a tapered shape and make up a nozzle (particle injection unit) that injects the particles 1 together with carrier gas toward the substrate 2. The region between the first pipe 9X and the third pipe 30 is also called a central nozzle 4X because it is located at the center.

Figure 10A:
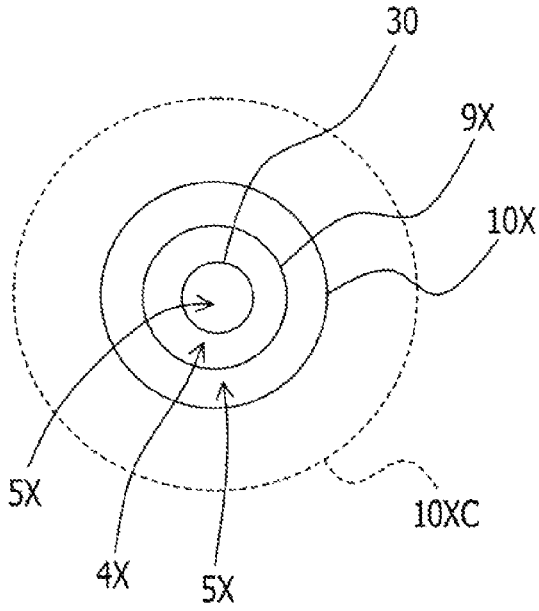
FIGS. 10A and 10B are schematic sectional views along the A-A' line in FIG. 9 illustrating configuration examples of a triple pipe nozzle provided with the film deposition device according to the second embodiment.
Figure 10B:
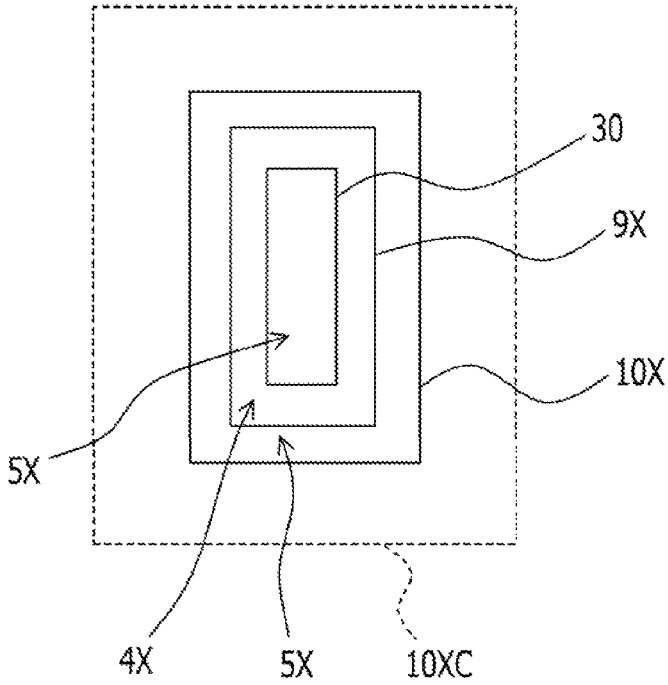

The nozzle 4X may be a circular nozzle with a cross-sectional shape as illustrated in FIG. 10A or a flat nozzle with a rectangular cross-sectional shape illustrated in FIG. 10B. However, when the rectangular ring-shaped flat nozzle is used, speed of the particles 1 depends on a position in the longitudinal direction of the nozzle 4X and the speed slows down at the edge, thereby a deposition state of the particles 1 may be changed. In contrast, when a ring-shaped circular nozzle is used, speed of the particles 1 does not depend on a position in the circumferential direction. Hence, a deposition state of the particles 1 may not be changed.

The suction unit 5X is configured around the nozzle 4X in a region inside of the third pipe 30 and sucks particles 1 that are not deposited over the substrate 2 among the particles 1 injected from the nozzle 4X.

The second pipe 10X is mounted so as to substantially cover the first pipe 9X. The suction unit 5X is configured around the nozzle 4X in a region between the first pipe 9X and the second pipe 10X and sucks particles 1 that are not deposited over the substrate 2 among the particles 1 injected from the nozzle 4X.

In other words, the region inside the third pipe 30 and the region between the first pipe 9X and the second pipe 10X are coupled to the vacuum source 6 (vacuum pump etc.) through the piping 7. The regions make up the suction unit 5X (particles suction unit) that sucks the particles 1 that are not deposited over the substrate 2 together with carrier gas. The vacuum source 6 exhausts gas (including particles) in the suction unit 5X; thereby the particles 1 that are not deposited over the substrate 2 are sucked and removed. As a result, negative pressure prevails in the suction unit 5. A cross-sectional shape of the suction unit 5X may be a shape corresponding to the shape of the nozzle 4X as illustrated in FIGS. 10A and 10B.

The suction unit 5X that is configured with the third pipe 30, and the suction unit 5X that is made up of the first pipe 9X and the second pipe 10X is also called a suction nozzle that sucks carrier gas and the particles 1. The suction unit 5X that is made up of the third pipe 30 is located inside of the nozzle 4X, thus also called an internal nozzle. The suction unit 5X that is made up of the first pipe 9X and the second pipe 10X is located outside of the nozzle 4X, thus also called an external nozzle. Moreover, the suction unit 5X that is made up of the first pipe 9X and the second pipe 10X is provided at the periphery of the nozzle 4X with a ring and pipe shapes, thus also called a ring-shaped suction pipe or a ring-shaped external pipe. The entire triple pipe structure is also called triple pipe nozzle 11X (multiple structure nozzle, triple structure nozzle, multiple pipe nozzle, and a nozzle with a suction pipe).

In the second pipe 10X, a tip end (injection unit) side of the nozzle 4X (a region between the first pipe 9X and the third pipe 30) is longer than the nozzle 4X. A flat portion 10XA (cover unit) that includes an opening portion 10XB at a position opposing to the nozzle 4X is provided so as to substantially cover an end part of the second pipe 10X at a side where the second pipe 10X is longer than the nozzle 4.

In the second pipe 10X, the flat portion 10XA opposes to the substrate 2, and the flat portion 10XA and the substrate 2 are provided so that a clearance 12 is provided therebetween. In other words, the flat portion 10XA of the second pipe 10X is provided substantially in parallel with the substrate 2 and extends to a direction along a surface of the substrate 2.

The particles 1 injected from the nozzle 4X deposit over the deposition point over the surface of the substrate 2 and may not deposit or attach to a region around the deposition point. Among the particles 1 that collide with the substrate 2, the particles 1 that are rebounded from the substrate 2 are sucked by suction unit 5X. Accordingly, scattering of the particles 1 may be reduced, if not prevented, thereby the particles 1 may not contaminate periphery (for example, the deposition chamber) and the substrate 2.

The suction unit 5X, in other words, the region between the first pipe 9X and the second pipe 10X, and the region inside the third pipe 30 are coupled to the vacuum source 6, thus the region is under a negative pressure (low pressure, reduced pressure). The suction unit 5 is provided so as to substantially cover the nozzle 4X, thus a region around the nozzle 4X is under a negative pressure.

When pressure in the suction unit 5X is negative pressure, gas flows into the suction unit 5X from the outside through the clearance 12 between the flat portion 10XA and the substrate 2, and the opening portion 10XB. Leakage of the particles 1 to the outside (for example, the deposition chamber) may be reduced if not prevented by flowing gas through the clearance 12 between the flat portion 10XA and the substrate 12.

A flow rate of gas that flows into the suction unit 5X and the deposition point may be adjusted by adjusting a size (width, height, and length) of the clearance 12 between the flat portion 10XA of the second pipe 10X and the substrate 2. Accordingly, pressure in the suction unit 5X and pressure in the deposition point may be adjusted.

In order to make a length of the flat portion 10XA of the second pipe 10X (a length along the substrate 2) long, the second pipe 10X includes a tapered part (skirt part) 10XC a cross-section of which becomes larger with a tapered shape at an end of a side where the second pipe 10X is longer than the nozzle 4X.

By adjusting a size of the clearance 12 between the flat portion 10XA of the second pipe 10X and the substrate 2, pressure in the suction unit 5X, in particular, pressure in a region from a tip end of the nozzle 4X to the substrate 2 (including the deposition point) may be maintained to a negative pressure (low pressure). Accordingly, the particles 1 injected from the nozzle 4X are less likely to slow down, thereby the particles 1 may collide with the substrate 2 at high speed, deposition of the particles 1 over the substrate 2 is promoted, thereby a film that includes the particles 1 may be grown.

The deposition chamber may not be required to make negative pressure in the region around the nozzle 4X, in particular, the region from the tip end of the nozzle 4X to the substrate 2 (including the deposition point). In other words, without providing the deposition chamber, the particles 1 may collide with the substrate 2 at high speed and the film that includes the particles 1 may be grown over the substrate 2.

By adjusting a size of the clearance 12 between the flat portion 10XA of the second pipe 10X and the substrate 2, a flow rate of gas flowing into the suction unit 5X and the deposition point, and thus pressure in the suction unit 5X and the deposition point may be adjusted. Accordingly, the speed of the particles 1 may be controlled.

Other details of the embodiment will not be described because the details are substantially the same as those described in the first embodiment (including specific configuration examples) and alternative embodiments. Substantially the same conditions such as for a flow rate of specific configuration examples for the dual pipe structure may be used.

According to the film deposition device and the film deposition method of the embodiment, a film that includes the particles 1 may be formed over the substrate 2 by making the particles 1 collide with the substrate 2 while reducing if not preventing scattering of the particles 1 and reducing if not preventing contamination of the deposition chamber 15 and the substrate 2 by the particles 1.

A third embodiment differs from the above described first embodiment in that the third embodiment provides a triple pipe structure while the first embodiment provides the double pipe structure (refer to FIG. 1).

Figure 11:
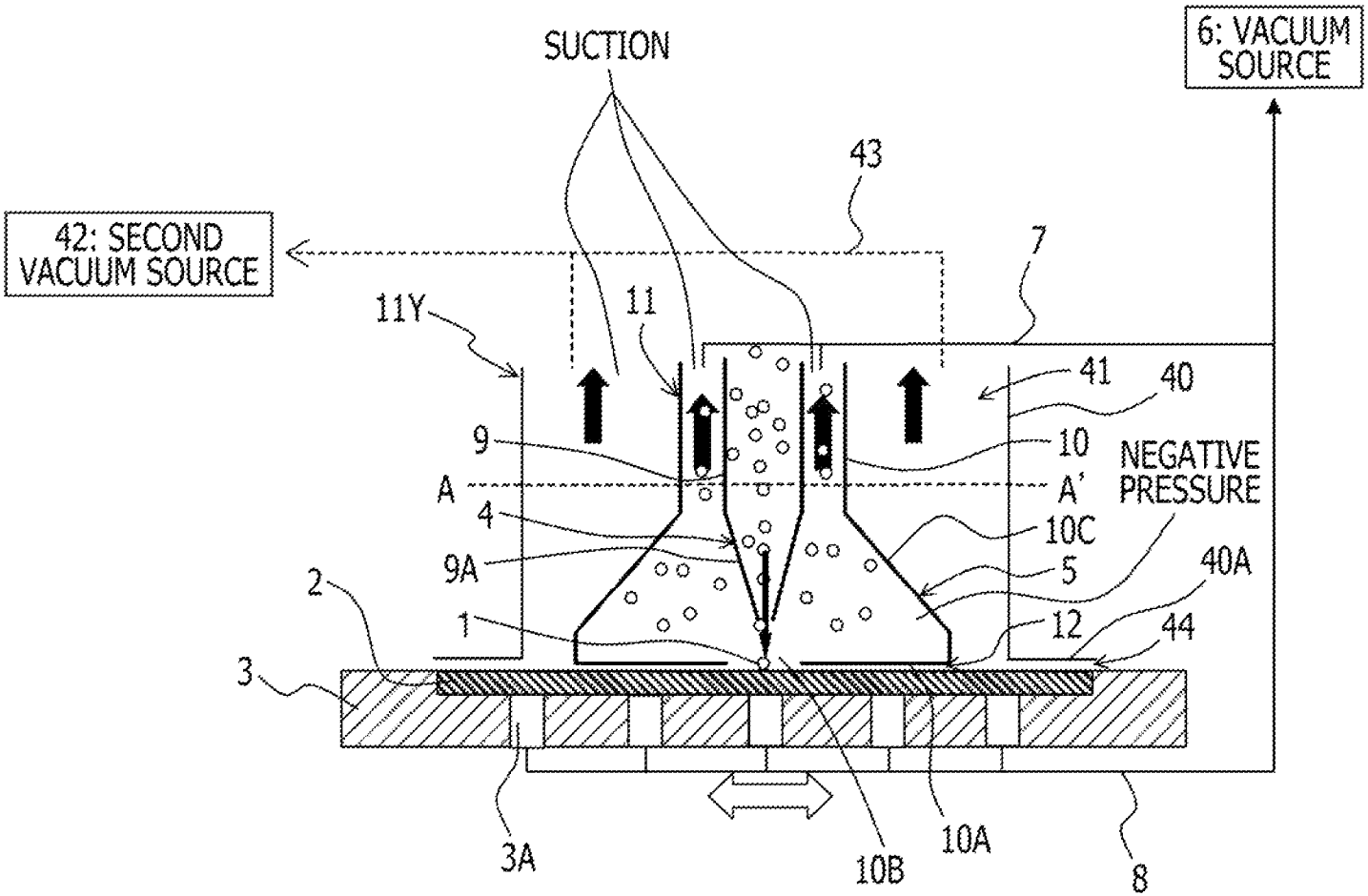
FIG. 11 is a schematic sectional view illustrating a film deposition device according to a third embodiment.

The third embodiment includes, as illustrated in FIG. 11, a triple pipe structure (multiple structure) that is made up of a first pipe 9, a second pipe 10 located outside of the first pipe 9, and a fourth pipe 40 located outside of the second pipe 10.

According to the embodiment, as in the above described first embodiment (refer to FIG. 1), a nozzle 4 and a suction unit 5 are provided in a double pipe structure that includes the first pipe 9 and the second pipe 10 located outside of the first pipe 10 and a fourth pipe 40 is provided outside of the double pipe structure to make the triple pipe structure. In FIG. 11, the same reference numerals are applied to elements that are the same as the elements in FIG. 1.

According to the embodiment, the fourth pipe 40 is mounted so as to cover the second pipe 10. A gas suction unit 41 is provided around a double pipe nozzle 11 in a region between the fourth pipe 40 and the second pipe 10 and sucks gas around the double pipe nozzle 11.

Figure 12A:
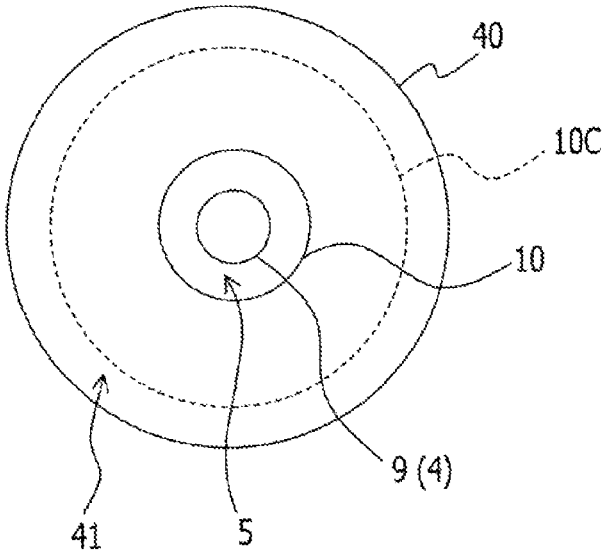
FIGS. 12A and 12B are schematic sectional views along A-A' line in FIG. 11 illustrating the triple pipe nozzle provided with the film deposition device according to the third embodiment.
Figure 12B:
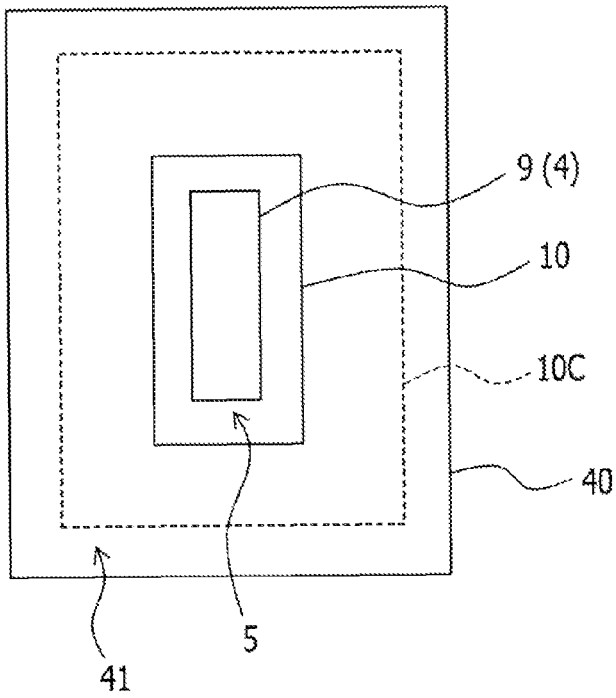

The region between the fourth pipe 40 and the second pipe 10 is coupled to a vacuum source 42 (a second vacuum source, vacuum pump etc.) through a piping 43. The vacuum source 42 exhausts gas inside of a gas suction unit 41; thereby gas around the double pipe nozzle 11 is sucked. As a result, pressure around the double pipe nozzle 11 becomes negative pressure. A cross-sectional shape of the gas suction unit 41 may be a shape corresponding to the cross-sectional shape of the nozzle 4, for example, the shapes as illustrated in FIGS. 12A and 12B. In FIGS. 12A and 12B, the same reference numerals are applied to elements that are the same as the elements in FIG. 1.

As illustrated in FIG. 11, a region between the fourth pipe 40 and the second pipe 10 is coupled to a second vacuum source 42 that differs from the first vacuum source 6 coupled to the region between the first pipe 9 and the second pipe 10. Pressure in the region between the first pipe 9 and the second pipe 10, in other words, in the suction unit 5 and pressure in the region between the fourth pipe 40 and the second pipe 10, in other words, in the gas suction unit 41 may be independently adjusted.

When vacuum pumps are used as the vacuum sources 6 and 42, exhaust velocity of the vacuum pump 42 coupled in the region between the fourth pipe 40 and the second pipe 10 is preferably substantially the same exhaust velocity or more of the vacuum pump 6 coupled to the region between the first pipe 9 and the second pipe 10.

The gas suction unit 41 that is configured with the fourth pipe 40 and the second pipe 10 is called a gas suction nozzle for sucking gas. The gas suction unit 41 is located the outside, thus also called an external nozzle. The gas suction unit 41 is provided with a ring and pipe shapes, thus also called a ring-shaped suction pipe. The suction unit 5 is located at the center, thus also called a center nozzle. Moreover, the suction unit 5 is provided at the periphery of the nozzle 4 with a ring and pipe shapes, thus also called a ring-shaped suction pipe. The entire triple pipe structure is also called triple pipe nozzle 11Y (multiple structure nozzle, triple structure nozzle, multiple pipe nozzle, a nozzle with a suction pipe).

A flow rate of gas that flows into the deposition point and the suction unit 5 through a clearance 12 between a flat portion 10A and the substrate 2 may be adjusted by sucking gas around the double pipe nozzle 11. Accordingly, pressure in the deposition point and the suction unit 5 may be adjusted.

According to the embodiment, a film that includes the particles 1 is formed over the substrate 2 by injecting the particles 1 from the nozzle 4 that is made up of an inner most pipe, the first pipe 9, and by making the particles 1 collide with the substrate 2. Two regions made up of the outer two pipes 10 and 40 are coupled to different vacuum sources 6 and 42 respectively. The inner region, in other words, mainly the region between the first pipe 9 and the second pipe 10 sucks the particles 1 and the carrier gas. On the other hand, the outer region, in other words, the region between the second pipe 10 and the fourth pipe 40 sucks gas around the double pipe nozzle 11. Accordingly, a flow rate of gas that flows into the deposition point and the suction unit 5 through a clearance 12 between the flat portion 10A and the substrate 2 is adjusted; thereby pressure in the deposition point and the suction unit 5 is adjusted. Thus, deposition conditions (for example, pressure in the deposition point etc.) may be accurately controlled.

The fourth pipe 40, at an end of the tip end side, includes a flange portion 40 A. The fourth pipe 40 is provided so that the flange portion 40A opposes to the substrate 2, and a clearance 44 is provided between the flange portion 40A and the substrate 2. In other words, the flange portion 40A of the fourth pipe 40 is provided substantially in parallel with the substrate 2 and extends to a direction along a surface of the substrate 2.

A flow rate of gas that flows from the outside into the inside of the gas suction unit 41 may be adjusted by adjusting a size (width, height, and length) of the clearance 44 between the flange portion 40A of the fourth pipe 40 and the substrate 2. Accordingly, pressure in the suction unit 41 may be adjusted.

Other details of the embodiment are substantially the same as those described in the first embodiment (including specific configuration examples) and alternative embodiments. Thus, the details will not be described. Substantially the same conditions as for the dual pipe structure such as for a flow rate of specific configuration examples may be used.

According to the film deposition device and the film deposition method of the embodiment, a film that includes the particles 1 may be formed over the substrate 2 by making the particles 1 collide with the substrate 2 while reducing if not preventing scattering of the particles 1, thereby the particles 1 may not contaminate the deposition chamber 15 and the substrate 2 by the particles 1.

Figure 13:
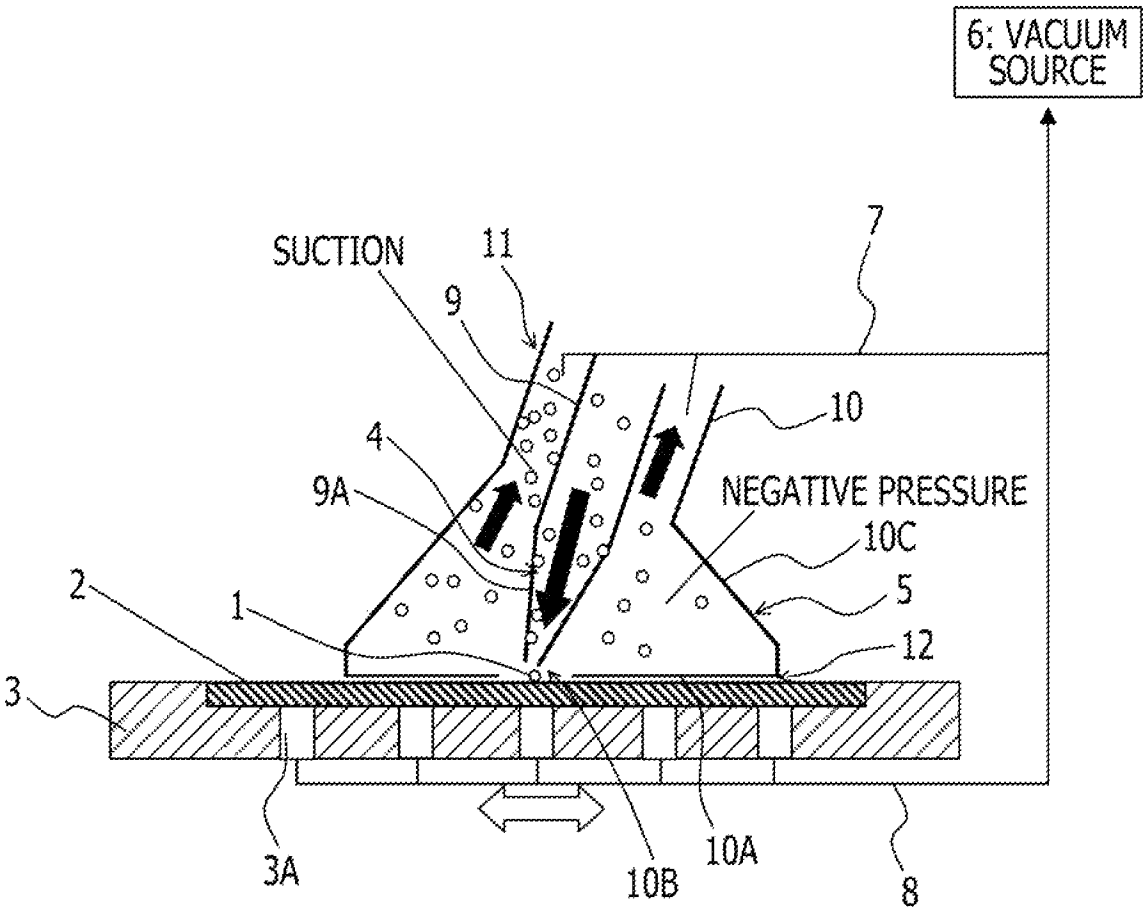
FIG. 13 is a schematic sectional view illustrating a configuration example of an alternative embodiment of the film deposition devices according to the first to third embodiments.

According to each of the above described embodiments, the nozzle 4 and the nozzle 4X are provided along a direction substantially orthogonal to the surface of the substrate 2, and making the particles 1 collide with the substrate 2 from the direction substantially orthogonal to the surface of the substrate 2. However, the direction is not limited to this. For example, as illustrated in FIG. 13, the nozzle 4 is tilted from a direction substantially orthogonal to the surface of the substrate 2 and making the particles 1 collide with the substrate 2 from the direction tilted from substantially orthogonal to the surface of the substrate 2. Accordingly, a film with good quality may be obtained according to a size and quality of the particles 1. In FIG. 13, the same reference numerals are applied to elements that are the same as the elements in FIG. 1.

Figure 14:
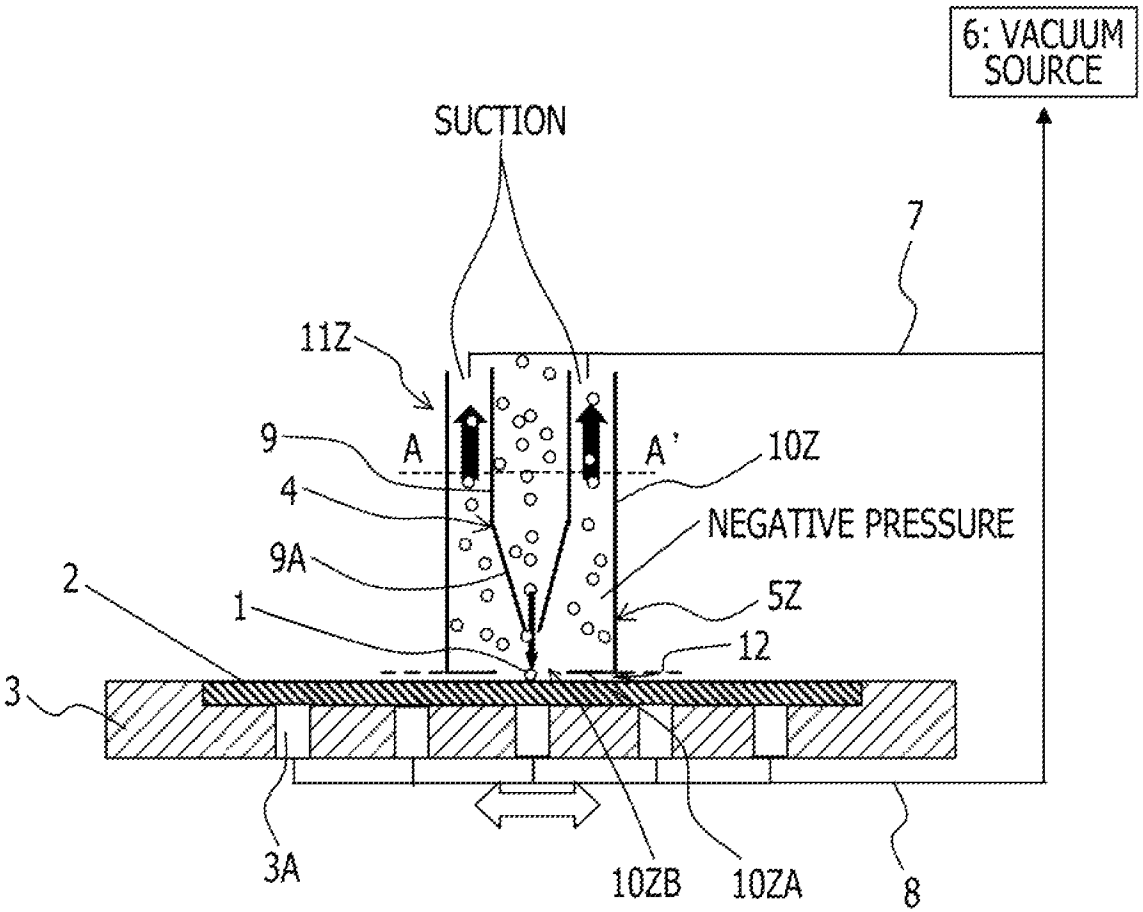
FIG. 14 is a schematic sectional view illustrating a configuration example of an alternative embodiment of the film deposition devices according to the first to third embodiments.

According to each of the above described embodiments, the second pipes 10 and 10X include the skirt parts 10C and 10XC respectively, however, the embodiment is not limited to this. For example, as illustrated in FIG. 14, a second pipe 10Z that makes up the suction unit 5Z may not include a skirt part. In other words, a double pipe nozzle 11Z may be configured so that the second pipe 10Z that makes up the suction unit 5Z provides substantially the same cross-sectional shape along a longitudinal direction. In FIG. 14, the same reference numerals are applied to elements that are the same as the elements in FIG. 1.

Figure 15A:
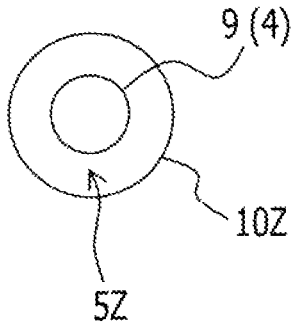
FIGS. 15A and 15B are schematic sectional views along A-A' line in FIG. 14 illustrating a configuration example of a dual pipe nozzle provided with the film deposition device according to alternative embodiments of film deposition devices of the first to the third embodiments.
Figure 15B:
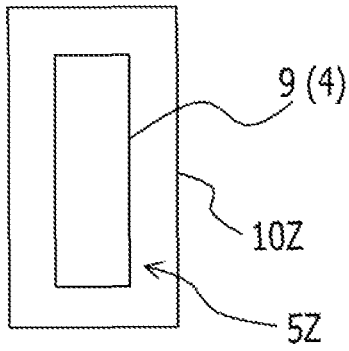
Figure 16:
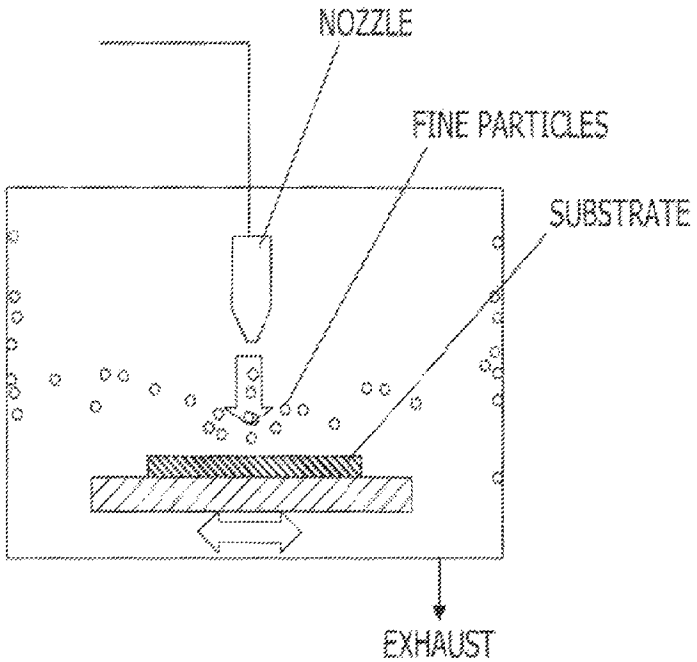
FIG.16 RELATED ART
FIG. 16 is a schematic sectional view illustrating a film deposition device.

The nozzle 4 may be a circular noise with a cross-sectional shape as illustrated in FIG. 15A or a flat nozzle with a cross-sectional shape as illustrated in FIG. 15B. A cross-sectional shape of the suction unit 5Z may be a shape corresponding to the cross-sectional shape of the nozzle 4, for example, the shapes as illustrated in FIGS. 15A and 15B.

As indicated by the dotted line in FIG. 14, a length of the flat unit 10ZA (a direction along the substrate 2) may be extended so that the flat portion 10ZA with an opening portion 10ZB is projected outside. Accordingly, a size of the clearance 12 between the flat portion 10ZA of the second pipe 10Z and the substrate 2 may be adjusted. As a result, a flow rate of gas that flows into the deposition point and the suction unit 5Z may be adjusted; thereby pressure in the deposition point and the suction unit 5Z may be adjusted.

All examples and conditional language recited herein are intended for pedagogical purposes to aid the reader in understanding the invention and the concepts contributed by the inventor to furthering the art, and are to be construed as being without limitation to such specifically recited examples and conditions. Although the embodiments in accordance with aspects of the present inventions have been described in detail, it should be understood that the various changes, substitutions, and alterations could be made hereto without departing from the spirit and scope of the invention.

What is claimed is:

1. A film deposition device comprising:

a nozzle configured to inject a plurality of particles to a target;

a suction unit provided around the nozzle and configured to suck particles that are rebounded from the target among the plurality of particles injected from the nozzle; and a pipe structure configured to include a first pipe, a second pipe located outside of the first pipe, and a third pipe located inside of the first pipe, wherein the nozzle is configured with a region between the first pipe and the third pipe; and the suction unit is configured with a region between the first pipe and the second pipe and a region inside of the third pipe.

2. The film deposition device according to claim 1, wherein the suction unit is coupled to a vacuum source.

3. The film deposition device according to claim 2, further comprising:

a stage configured to hold the target, wherein the stage includes a retaining arrangement configured to retain the target; and the retaining arrangement is coupled to the vacuum source.

4. The film deposition device according to claim 1, wherein the nozzle and the suction unit are located below the target.

5. The film deposition device according to claim 1, wherein the pipe structure is further configured to include a fourth pipe located outside of the second pipe, and the film deposition device further comprises a gas suction unit configured to suck gas provided in a region between the fourth pipe and the second pipe.

6. The film deposition device according to claim 1, further comprising: a cover unit configured to include an opening at a position opposing to the nozzle so as to substantially cover an end part of the second pipe.

7. The film deposition device according to claim 6, wherein the second pipe is positioned so that the cover unit opposes to the target and a clearance is provided between the cover unit and the target.

8. The film deposition device according to claim 7, further comprising: an adjustment unit configured to adjust a position of the second pipe or the target.

9. The film deposition device according to claim 1, further comprising: a collection unit coupled to the suction unit and configured to collect the plurality of particles.

10. The film deposition device according to claim 1, wherein the nozzle is tilted from a direction substantially orthogonal to a surface of the target.

* * * * *